US007407574B2

(12) United States Patent
Robinson

(10) Patent No.: US 7,407,574 B2
(45) Date of Patent: Aug. 5, 2008

(54) ROOFTOP DRAINAGE DEVICE

(76) Inventor: Donnell Robinson, 825 52nd St., Oakland, CA (US) 94608

( * ) Notice: Subject to any disclaimer, the term of this patent is extended or adjusted under 35 U.S.C. 154(b) by 164 days.

(21) Appl. No.: 11/365,909

(22) Filed: Mar. 1, 2006

(65) Prior Publication Data

US 2007/0205144 A1 Sep. 6, 2007

(51) Int. Cl.
*B01D 35/02* (2006.01)
*E04D 13/04* (2006.01)

(52) U.S. Cl. ..... 210/163; 52/12; 52/302.7; D23/261

(58) Field of Classification Search ..... None
See application file for complete search history.

(56) References Cited

U.S. PATENT DOCUMENTS 1,674,347 A * 6/1928 Silverman ..... 210/166
1,746,683 A * 2/1930 Schifter ..... 4/287
1,791,512 A * 2/1931 Schurman ..... 210/163
1,903,366 A * 4/1933 Mercier et al. ..... 4/292
1,918,509 A * 7/1933 Wilcox ..... 210/166
1,973,321 A * 9/1934 Schultz ..... 210/163
1,996,279 A * 4/1935 Dillon ..... 4/292
1,999,277 A * 4/1935 Boosey ..... 210/163
D101,978 S * 11/1936 Williams ..... D23/261
2,283,160 A * 5/1942 Boosey ..... 210/163
2,311,654 A * 2/1943 Filkins ..... 210/166
2,485,547 A * 10/1949 Blau ..... 210/354
2,666,493 A * 1/1954 Gordon ..... 210/166
2,672,983 A * 3/1954 Blau ..... 210/354
2,740,490 A * 4/1956 Matheis ..... 210/166
2,807,368 A * 9/1957 Blau ..... 210/463
2,837,212 A * 6/1958 Schmid ..... 210/166
3,121,682 A * 2/1964 Alberico ..... 210/166
3,357,561 A * 12/1967 Schmid et al. ..... 210/163
3,378,858 A * 4/1968 Jacuzzi ..... 210/163
3,392,844 A * 7/1968 Decarie ..... 210/463
3,469,698 A * 9/1969 Blendermann ..... 210/163
3,469,699 A * 9/1969 Blendermann et al. ..... 210/166
3,517,813 A * 6/1970 Thaler ..... 210/166
3,529,723 A * 9/1970 Hagedorn ..... 210/163
3,667,611 A * 6/1972 Pansini ..... 210/244
3,884,809 A * 5/1975 Logsdon ..... 210/163
3,932,281 A * 1/1976 Pansini ..... 210/163
4,035,297 A * 7/1977 Aldridge et al. ..... 210/163

(Continued)

FOREIGN PATENT DOCUMENTS

GB 2078830 A * 1/1982

OTHER PUBLICATIONS

*Roofmaster Products Company—Quality Tools and Equipment*; 2004 catalog, pp. 87-94.

*Primary Examiner*—Robert James Popovics
(74) *Attorney, Agent, or Firm*—Strategic Patent Group, P.C.

(57) ABSTRACT

A rooftop drainage device is provided for use in protecting rooftop drainpipes from clogging. An exemplary embodiment of the drainage device includes a filter comprising at least three sides, wherein at least one of the sides includes a plurality of apertures for allowing liquid to pass-through the at least one side into the drainpipe, while filtering debris; and an object receptacle mounted to a top of the filter for removably retaining an object, wherein a weight of the object holds the rooftop drainage device on the rooftop and over the drainpipe without need for mechanical fasteners.

20 Claims, 2 Drawing Sheets

U.S. PATENT DOCUMENTS 4,107,929 A * 8/1978 Ebeling et al. ..... 405/119
4,112,691 A * 9/1978 Ebeling et al. ..... 405/119
4,134,162 A * 1/1979 Sharland et al. ..... 4/292
4,170,047 A * 10/1979 Corsette et al. ..... 4/293
4,257,892 A * 3/1981 Boersma ..... 210/163
4,400,272 A * 8/1983 Logsdon ..... 210/166
4,487,690 A * 12/1984 Logsdon ..... 210/163
4,525,273 A * 6/1985 Logsdon ..... 210/164
4,652,365 A * 3/1987 Ebeling ..... 210/163
4,658,449 A * 4/1987 Martin ..... 4/496
4,799,713 A * 1/1989 Uglow ..... 285/42
D319,295 S * 8/1991 Ohaus ..... D23/261
5,087,151 A * 2/1992 DiTullio ..... 405/43
5,234,582 A * 8/1993 Savoie ..... 210/163
D341,413 S * 11/1993 Nichols ..... D23/261
5,297,895 A * 3/1994 Johnson ..... 405/41
5,394,657 A * 3/1995 Peterson ..... 52/12
5,409,602 A * 4/1995 Sorenson ..... 210/162
5,469,670 A * 11/1995 Thaler ..... 52/12
5,526,613 A * 6/1996 Simeone, Jr. ..... 52/12
5,615,526 A * 4/1997 Palmer et al. ..... 52/302.1
5,618,416 A * 4/1997 Haefner ..... 210/163
5,650,065 A * 7/1997 Sewell ..... 210/166
5,689,928 A * 11/1997 Rasksen ..... 52/302.1
5,724,777 A * 3/1998 Hubbard ..... 52/198
5,735,091 A * 4/1998 Hawkins et al. ..... 52/302.7
5,791,156 A * 8/1998 Strautman et al. ..... 62/244
5,843,306 A * 12/1998 Singleton ..... 210/163
5,966,884 A * 10/1999 Uglow ..... 52/302.1
6,004,457 A * 12/1999 Singleton ..... 210/163
6,059,964 A * 5/2000 Strawser, Sr. ..... 210/164
6,165,357 A * 12/2000 Cormier ..... 210/163
6,209,586 B1 * 4/2001 Wright ..... 138/96 R
6,261,445 B1 * 7/2001 Singleton ..... 210/163
D446,844 S * 8/2001 Claussen et al. ..... D23/261
6,282,846 B1 * 9/2001 Nocella ..... 52/24
6,340,035 B2 * 1/2002 Wright ..... 138/96 R
D460,810 S * 7/2002 Sommerhein ..... D23/261
6,416,674 B1 * 7/2002 Singleton et al. ..... 210/747
6,428,693 B2 * 8/2002 Singleton ..... 210/163
6,442,774 B2 * 9/2002 Wilson et al. ..... 4/504
6,453,482 B1 * 9/2002 Mullings ..... 4/507
D466,198 S * 11/2002 Mullings ..... 423/261
6,484,453 B2 * 11/2002 Nocella ..... 52/24
6,557,588 B2 * 5/2003 Wright ..... 138/96 R
6,588,029 B2 * 7/2003 Mullings ..... 4/507
6,609,257 B1 * 8/2003 O'Geary ..... 4/652
6,631,588 B1 * 10/2003 Distler ..... 52/12
6,647,682 B2 * 11/2003 Bishop ..... 52/302.1
6,749,366 B1 * 6/2004 Chinn et al. ..... 405/41
6,779,314 B1 * 8/2004 Fan ..... 52/309.12
6,833,067 B2 * 12/2004 Dresmann ..... 210/163
6,871,466 B2 * 3/2005 Fan ..... 52/583.1
6,953,208 B2 * 10/2005 Warnecke ..... 285/42
7,005,061 B1 * 2/2006 Downs et al. ..... 210/163
7,040,066 B2 * 5/2006 Fan ..... 52/309.12
7,300,573 B1 * 11/2007 Trangsrud ..... 210/163
2001/0023842 A1 * 9/2001 Singleton ..... 210/163
2001/0047627 A1 * 12/2001 Nocella ..... 52/24
2002/0100224 A1 * 8/2002 Martin ..... 52/14
2003/0037498 A1 * 2/2003 Bishop ..... 52/302.1
2003/0201217 A1 * 10/2003 Dresmann ..... 210/163
2006/0278573 A1 * 12/2006 Robinson ..... 210/460
2007/0205144 A1 * 9/2007 Robinson ..... 210/163

* cited by examiner

ROOFTOP DRAINAGE DEVICE

FIELD OF THE INVENTION

The present invention relates to a drainpipe protection apparatus, and more particularly to an improved rooftop drainage device.

BACKGROUND OF THE INVENTION

Rooftop drain covers are used to protect drainpipes that protrude from flat surfaces of rooftops. There are many types of rooftop drainpipe protection systems in use today. Most type of rooftop protection systems attach to roofing and attempt to block debris from entering the drainpipe. One type of rooftop drain has a one-piece body that includes and a drain flange/ring, a pipe that is inserted into the drainpipe opening, and a strainer dome that sits over the drainpipe to filter debris. A mechanical compression seal may be used to provide a watertight connection to the drainpipe. Similar drain covers are used to protect drains that provide rooftop through-wall/site-wall drainage, called scupper drains. The drain are mostly made of some type of metal, including aluminum, steel and copper, but may also be made of other materials.

Although conventional rooftop drain covers are widely used, experience has shown that these devices have drawbacks. One drawback is that conventional rooftop drain covers have to be mechanically fastened down, typically with screws, bolts, and/or drain seals. This creates a potential problem with the rooftop itself because holes for the screws/bolts need to be created in the roof during the installation process, damaging the roof.

Another drawback is that despite wide use of these devices, the drainpipes that are supposedly protected by these devices still often become clogged by leaves and debris. One reason for this is that the wires comprising the drain domes are often spaced too far apart and allow debris to filter through the dome itself and into the drainpipe. And, because some drains are made of thin metal, they can rust and become weak, and are therefore collapsible over time.

BRIEF SUMMARY OF THE INVENTION

The present invention provides a rooftop drainage device for use in protecting rooftop drainpipes from clogging. An exemplary embodiment of the drainage device includes a filter comprising at least three sides, wherein at least one of the sides includes a plurality of apertures for allowing liquid to pass-through the at least one side into the drainpipe, while filtering debris; and an object receptacle mounted to a top of the filter for removably retaining an object, wherein a weight of the object holds the rooftop drainage device on the rooftop and over the drainpipe without need for mechanical fasteners.

According to method and apparatus disclosed herein, the rooftop drainage device of the present invention requires no tools to put together, requires no tools to insert, requires no fasteners to hold in place, has no moving parts, has no nuts and bolts or rings, is made of a material that does not rust, can be placed over existing roof drain covers for added protection, and is easily moved by simply removing the object and moving the device.

DETAILED DESCRIPTION OF THE INVENTION

The present invention relates to a rooftop drainpipe protection apparatus. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1:
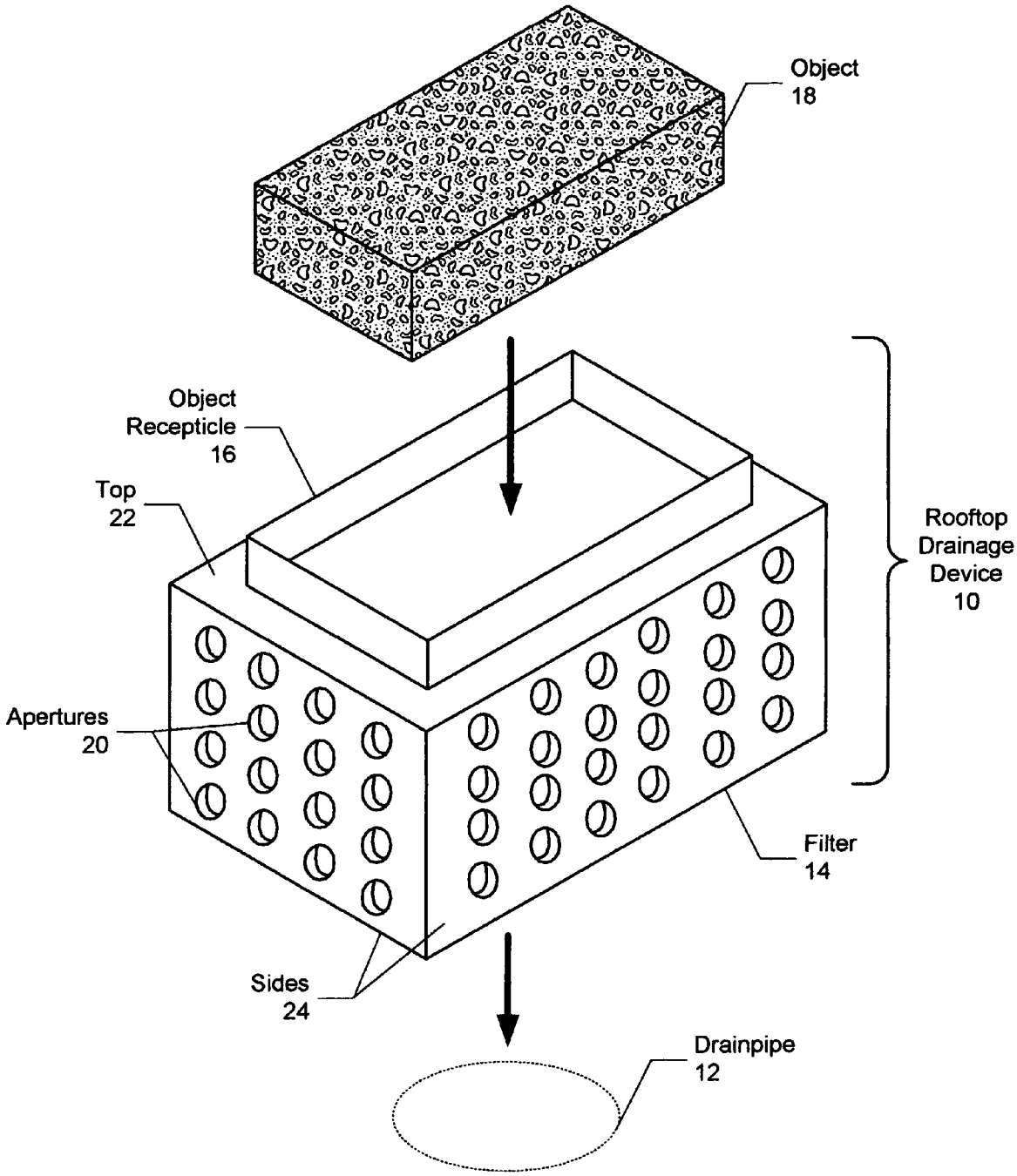
FIG. 1 is a block diagram illustrating an exemplary embodiment of the rooftop drainage device of the present invention.

The present invention provides an improved rooftop drainage device. FIG. 1 is a block diagram illustrating an exemplary preferred embodiment of the rooftop drainage device 10 of the present invention. The rooftop drainage device 10 is designed to be removably mounted to a rooftop (not shown) and over a drainpipe 12 that protrudes through the rooftop. According to the exemplary embodiment, the rooftop drainage device 10 includes a filter 14 for filtering debris, and an object receptacle 16 for removably retaining an object 18, such a brick, such that the weight of the object 18 holds the rooftop drainage device 10 on the rooftop and over the drainpipe 12. The filter 14 also preferably includes sides that include several apertures 20 that are sized to significantly reduce the amount debris, such as leaves, from entering the drainpipe 12, and may include optional fins (See FIG. 2) that reduce the amount of debris that accumulates against the apertures to prevent the apertures themselves from clogging.

To install the rooftop drainage device 10, a person places the rooftop drainage device 10 on a rooftop over the drainpipe 12, and then places the object 18 in the object receptacle 16 to hold the rooftop drainage device 10 in place on the rooftop. Thus, no tools, tie-downs, or mechanical fasteners are needed to install and hold the rooftop drainage device 10 in place. To remove the rooftop drainage device 10, a person just need to lift the object 18 off of the drainage device 10 and carry away the drainage device 10.

The object receptacle 16: In an exemplary embodiment, the object receptacle 16 is rectangular in shape to conform to the shape of the object 18, which in the example shown, is a brick or cement block. The object receptacle 16 is mounted to a top 22 of the filter 14, and may also include sides sufficient enough in height to ensure that the object 18 is not easily displaced from the receptacle 16. In the exemplary embodiment, the object receptacle 16 is glued to the top 22, but the object receptacle 16 and the top 22 may be constructed as one piece. In alternative embodiments, the object receptacle 16 may be square, circular or oval in shape to hold other types of objects such as rocks, tiles, weights, and so forth.

The Filter 14: In the embodiment shown, the filter 14 includes a top 22, and four sides 22, where each of the sides 22 includes a plurality of apertures 20 for allowing liquid flowing through the gutter 12 to pass-through the sides 22 of the filter 14 and down the drainpipe 12, while filtering debris, such as leaves. In an alternative embodiment, only the sides 24 the filter 14 that are in the path of the water flow to the drain 12 may need to include the apertures 20.

In addition, although the rooftop drainage device 10 is shown with a top 22 and four sides 22, the rooftop drainage device 10 may be constructed with three sides 22 and a top 22 to fit scrupper drains. In the exemplary embodiment, each of the sides 22 is flat, although the sides 22 may also have a concave or convex shape. No matter the shape, each of the sides preferably lies substantially in its own plane. In the embodiment shown, the sides 24 of the filter 14 form a rectangle, but may form other shapes as well. For example, the rooftop drainage device 10 may be constructed with many small sides 22 that meet at angles sufficient to form a circle- or arch-shaped filter. In this case, the circle- or arch-shaped filter may also have a flat top that is circular or arch shaped as well.

Materials: In the exemplary embodiment, the sides 22 of the rooftop drainage device 10 containing the apertures 20 are made of solid pieces of nonmetal material in which the apertures are then cut out. In an alternative embodiment, the entire rooftop drainage device 10 or the two main components, the filter 14 and the object receptacle 16, may be constructed from a solid piece of nonmetal material. Examples of nonmetal materials include fiberglass, ceramic, and plastic, for instance. In one exemplary embodiment, the filter 14 and the object receptacle 16 are constructed of ¼" thick fiberglass pieces, which may be injection molded. Preferably, the filter 14 is made of see through nonmetal material, which simplifies determining the status of drainpipe 12. Because no metal is used, the rooftop drainage device 10 is rustproof and therefore relatively non-collapsible overtime. In one preferred embodiment, the pieces of nonmetal material may be glued together to form the filter 14, and the filter 14 may be glued to the object receptacle 16. Whether injection molded or glued, no nuts or bolts are required to assemble the rooftop drainage device 10.

The Apertures 20: In the exemplary embodiment, the apertures 20 cut into the sides 22 of the filter 14 are shaped as circles. In alternative embodiment, however, the apertures 20 may be other shapes, and the different aperture shapes may be utilized to on the same rooftop drainage device 10. For example, the rooftop drainage device 10 may include apertures 20 comprising any combination of circles, squares, rectangles, trapezoids, and ovals. Whatever aperture shape is used, however, what is important is that the apertures 20 be sized sufficiently small to prevent debris, primarily leaves, from entering the filter 14. In a preferred embodiment, the holes are ¼ inch in diameter, although the size of the apertures may vary depending on the particular side in which the aperture is located. For example, the sides of the filter 14 that will face secondary liquid runoff may have holes that are smaller than the sides that will face primary runoff. Thus, only liquid and perhaps small particles can pass-through the apertures 20 to enter the drainpipe 12, but nothing sufficient to clog the drainpipe 12.

In the first embodiment of the present invention, the rooftop drainage device 10 effectively prevents leaves from passing through the sides of the filter 12, but nothing prevents debris and leaves from pressing against the sides of the rooftop drainage device and over the apertures. The second embodiment of the rooftop drainage device prevents this from occurring.

Figure 2:
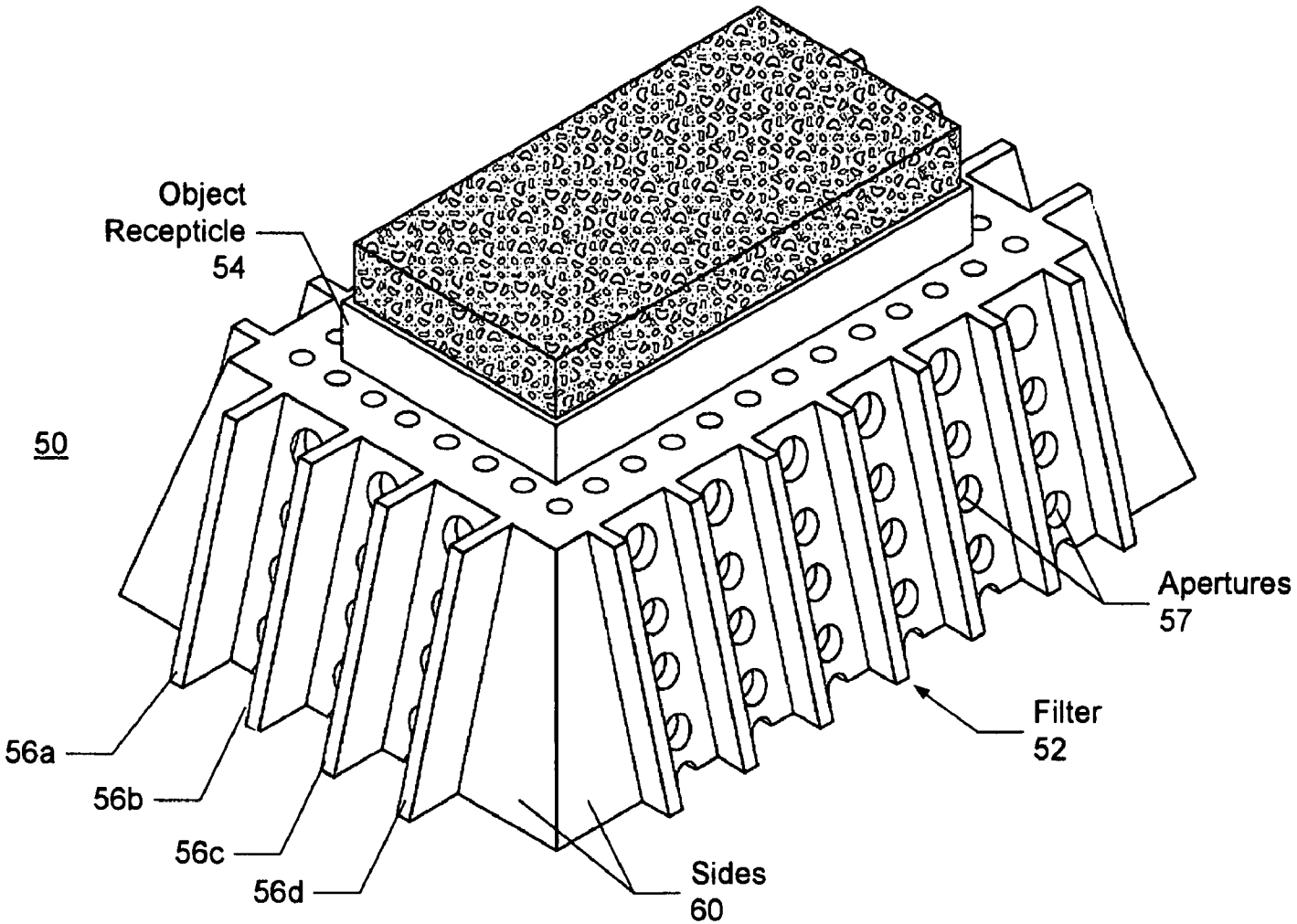
FIG. 2 is a block diagram showing a view of a rooftop drainage device according to a second exemplary embodiment.

FIG. 2 is a block diagram showing an isometric view of a rooftop drainage device according to a second exemplary embodiment. Similar to the first embodiment, the rooftop drainage device 50 of the second exemplary embodiment includes a filter 52 and an object receptacle 54. In this embodiment, side walls 60 of the filter 52 extend outward from the top to make a wider base for added stability.

According to this embodiment, the rooftop drainage device 50 further includes a plurality of fins 56*a*, 56*b*, 56*c*, and 56*d* (collectively referred to as fins 56) that protrude from the surface of the filter 52 for spacing debris away from the apertures 57 in the surface of the filter 52, thereby reducing the chance that the apertures 57 become clogged. The fins 56 may span the height of the sides 60, and preferably protrude perpendicular to the normals of respective sides 60 of the filter 52. Although the fins 56 are shown extending across the sides 60 vertically, the fins 56 may also be oriented horizontally or diagonally. In a further embodiment, the fins 56 may be formed as any shape that protrudes from the surface of the filter, such as blocks, circles or noncontiguous rectangles, for example. The top of the filter 54 may also include apertures 57, as shown, and/or fins 56.

An improved rooftop drainage device has been disclosed. According to the present invention, the rooftop drainage device, which only includes a filter and an object receptacle 54, has the following advantages over conventional device:

the rooftop drainage device requires no tools to put together or tools to install;

requires no fasteners to hold in place—instead, the drainage device is held in place by the weight of a removable object, such as brick/block;

has no moving parts, has no nuts, bolts, or rings;

is made of a material that does not rust, may have fins around it to keep debris from collecting over the sidewall apertures themselves;

can be placed over existing roof drain covers for added protection; and is easily moved by simply removing the object and moving the device.

The present invention has been described in accordance with the embodiments shown, and one of ordinary skill in the art will readily recognize that there could be variations to the embodiments, and any variations would be within the spirit and scope of the present invention. Accordingly, many modifications may be made by one of ordinary skill in the art without departing from the spirit and scope of the appended claims.

We claim:

1. In a rooftop drainage system, the improvement comprising a rooftop drainage device for removably covering a rooftop drainpipe, the rooftop drainage device comprising:

a filter comprising at least three sides, at least one of the sides includes a plurality of apertures for allowing liquid to pass-through the at least one side into the drainpipe, while filtering debris; and an object receptacle mounted to a top of the filter and removably retaining an object, wherein a weight of the object is sufficient, such that it holds the rooftop drainage device on the rooftop and over the drainpipe without use of mechanical fasteners.

2. The rooftop drainage device of claim 1 wherein the rooftop drainage device is made of nonmetal material.

3. The rooftop drainage device of claim 2 wherein the nonmetal material comprises at least one of fiberglass, ceramics, and plastic.

4. The rooftop drainage device of claim 3 wherein the rooftop drainage device is constructed from separate pieces of the nonmetal material.

5. The rooftop drainage device of claim 1 wherein the filter further includes a plurality of fins on at least one of the sides that protrude from a surface of the filter for spacing debris away from the apertures.

6. The rooftop drainage device of claim 1 wherein the sides are any combination of being flat, concave, and convex in shape.

7. The rooftop drainage device of claim 6 wherein each of the sides lies substantially in its own plane.

8. The rooftop drainage device of claim 1 wherein the object receptacle is rectangular in shape.

9. The rooftop drainage device of claim 8 wherein the object receptacle is designed to hold a rectangular object, including a brick.

10. The rooftop drainage device of claim 9 wherein the filter includes a top, and three sides for fitting over a scrupper drain.

11. The rooftop drainage device of claim 1 wherein the apertures are sized sufficiently small to prevent debris, primarily leaves, from entering the filter.

12. The rooftop drainage device of claim 11 wherein the apertures are ¼" in diameter.

13. The rooftop drainage device of claim 11 wherein the apertures in the at least one sides of the filter are shaped as circles.

14. The rooftop drainage device of claim 13 wherein the apertures comprise any combination of circles, squares, rectangles, trapezoids, and ovals.

15. In a rooftop drainage system, the improvement comprising a rooftop drainage device for removably covering a rooftop drainpipe, the rooftop drainage device comprising:

a filter comprising at least three sides, wherein the filter further includes, a plurality of apertures in at least one of the sides for allowing liquid to pass-through the at least one side into the drainpipe, while filtering debris, and a plurality of fins on the at least one side that protrude from a surface of the filter for spacing debris away from the apertures; and an object receptacle mounted to a top of the filter and removably retaining an object, wherein a weight of the object is sufficient, such that it holds the rooftop drainage device on the rooftop and over the drainpipe without use of mechanical fasteners.

16. The rooftop drainage device of claim 15 wherein the apertures are cut out of the nonmetal material and sized sufficiently small to prevent debris, including leaves, from entering the filter.

17. The rooftop drainage device of claim 16 wherein the nonmetal material comprises at least one of fiberglass, ceramics, and plastic.

18. The rooftop drainage device of claim 17 wherein the object receptacle is rectangular in shape.

19. The rooftop drainage device of claim 18 wherein the object receptacle is designed to hold a rectangular object, including a brick.

20. The rooftop drainage device of claim 17 wherein the filter includes at least four sides and a top.

* * * * *